US012480256B2

(12) United States Patent
Riihioja

(10) Patent No.: US 12,480,256 B2
(45) Date of Patent: Nov. 25, 2025

(54) BELT

(71) Applicant: Valmet Technologies Oy, Espoo (FI)

(72) Inventor: Vesa-Matti Riihioja, Tampere (FI)

(73) Assignee: Valmet Technologies Oy, Espoo (FI)

( * ) Notice: Subject to any disclaimer, the term of this patent is extended or adjusted under 35 U.S.C. 154(b) by 154 days.

(21) Appl. No.: 18/104,998

(22) Filed: Feb. 2, 2023

(65) Prior Publication Data

US 2023/0250583 A1 Aug. 10, 2023

(30) Foreign Application Priority Data

Feb. 4, 2022 (EP) ..... 22155154

(51) Int. Cl.
*D21F 3/02* (2006.01)

(52) U.S. Cl.
CPC ..... *D21F 3/0236* (2013.01); *D21F 3/0227* (2013.01)

(58) Field of Classification Search
CPC ..... D21F 3/0236
USPC ..... 428/141
See application file for complete search history.

(56) References Cited

U.S. PATENT DOCUMENTS 4,559,258 A * 12/1985 Kiuchi ..... D21F 3/0236 162/358.4
4,643,916 A * 2/1987 Kiuchi ..... D21F 3/0236 156/137
2002/0137416 A1* 9/2002 Hagfors ..... D21F 7/083 442/153
2006/0210769 A1* 9/2006 Swindlehurst ..... H01L 25/50 257/E21.705
2007/0148409 A1* 6/2007 Rios ..... B32B 27/20 428/167
2009/0035519 A1* 2/2009 Gaeta ..... B24D 3/004 428/141
2009/0162596 A1* 6/2009 Rios ..... A63B 60/14 428/141
2021/0363697 A1* 11/2021 Hagfors ..... D21F 1/40

FOREIGN PATENT DOCUMENTS

WO WO-2010066950 A3 * 12/2010 ..... C08G 18/10

* cited by examiner

*Primary Examiner* — Tahseen Khan
(74) *Attorney, Agent, or Firm* — Stiennon & Stiennon

(57) ABSTRACT

This invention relates to a method for manufacturing a belt for a paper, board, pulp or tissue machine, the belt (5) comprising a body (14), and a reinforcing structure (31, 32), the belt (5) having an inner surface (10) and an outer surface (11), wherein the method comprises: applying a coating comprising a solid lubricant on to a casting cylinder (18), drying the coating comprising the solid lubricant, thereby obtaining solid lubricant particles (29) on the casting cylinder (18), casting a body material (21) onto the casting cylinder (18) in order to form the body (14) on the solid lubricant particles, and providing the reinforcement structure (31, 32) into the belt, thereby obtaining the belt in which the solid lubricant particles forms at least part of the inner surface of the belt. This invention relates to an arrangement for manufacturing a belt for a paper, board, pulp or tissue machine. The invention further relates to a belt for a paper, board, pulp, or tissue machine.

12 Claims, 8 Drawing Sheets

BELT

CROSS REFERENCES TO RELATED APPLICATIONS

This application claims priority on EP22155154.2, filed Feb. 4, 2022, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a method for manufacturing a belt for a paper, board, pulp, or tissue machine. This invention relates to an arrangement for manufacturing a belt for a paper, board, pulp, or tissue machine. This invention further relates to a belt for a paper, board, pulp, or tissue machine.

Paper machines, as well as board, pulp, and tissue machines, are typically equipped with a forming section, a press section, and a drying section. In paper, pulp and board making, it is an issue how to increase the dewatering amount from wet fiber web in order to improve a production efficiency.

Nowadays, these machines typically have felts and wires to remove water from the fiber web. Water can be removed e.g., on the forming section through at least one forming wire, and on the press section e.g., by using felts.

A sleeve roll can be used e.g., in forming sections to improve dewatering from the wet fiber web. A shoe press can be used, for example, in press sections to improve dewatering therein.

SUMMARY OF THE INVENTION

The present invention relates to a belt for a paper, board, pulp, or tissue machine. One object of the present invention is to provide an improved belt.

Aspects of the invention are characterized by what is stated in the independent claims. Various embodiments of the invention are disclosed in the dependent claims.

A paper, board, pulp, or tissue machine may comprise a sleeve roll. The sleeve roll is typically located at a wire section of a paper, board, pulp, or tissue machine. Thanks to the sleeve roll, moisture removal of the wire section can be improved.

Alternatively, or in addition, a paper, board, pulp, or tissue machine may comprise one or more than one shoe press. The shoe press is typically located at a press section of a paper, board, pulp, or tissue machine. Thanks to the shoe press, moisture removal of the press section can be improved.

Therefore, a paper, board, pulp, or tissue machine may comprise at least one sleeve roll and/or at least one shoe press. The belt may be a sleeve roll belt, or a shoe press belt. The belt can be an impermeable belt.

The belt has an inner surface and an outer surface. The belt may comprise a body. Further, the belt may comprise a reinforcing structure, which may be e.g., embedded into the body. The belt may form a closed loop.

The inner surface of the belt may comprise a coating comprising a solid lubricant. The solid lubricant can be a friction modifier for lowering a friction between the belt and an outer surface of a shoe press or a sleeve roll.

Thus, the belt may comprise:

a reinforcing structure, and a body comprising a body material, wherein the inner surface of the belt comprises solid lubricant particles, a roughness value of the inner surface of the belt is in a range between 0.20 μm and 6 μm, determined according to standard ISO 4287:1997, and the outer surface of the belt is preferably free from the solid lubricant particles.

A method for manufacturing the belt may comprise the following steps:

applying a coating comprising a solid lubricant on to a casting cylinder, drying the coating comprising the solid lubricant, thereby obtaining solid lubricant particles on the casting cylinder, casting a body material onto the casting cylinder in order to form a body on the solid lubricant particles, and providing a reinforcement structure into the belt, thereby obtaining the belt in which the solid lubricant particles forms at least part of the inner surface of the belt.

The solid lubricant particles may form the inner surface of the belt together with the body material so that the inner surface comprises the solid lubricant particles and the body material. The solid lubricant particles may cover at least 10% of an area of the inner surface of the belt in order to reduce friction.

A roughness value of the inner surface of the belt, determined in a cross direction of the belt, may be in a range between 0.20 μm and 6 μm, preferably in a range between 0.40 μm and 3 μm, determined according to standard ISO 4287:1997. This roughness value may be used to reduce friction of the inner surface of the belt without affecting too much other properties of the belt Further, a roughness value of the inner surface of the belt, determined in a machine direction of the belt, may be in a range between 0.20 μm and 6 μm, preferably in a range between 0.40 μm and 3 μm, determined according to standard ISO 4287:1997. This roughness value may be used to reduce friction of the inner surface of the belt without affecting too much other properties of the belt. Further, roughness values of the inner surface of the belt are preferably similar in the cross direction and in the machine direction of the belt.

The solid lubricant particles may comprise at least one of polytetrafluoroethylene (PTFE), molybdenum disulfide ($MoS_2$), and graphite.

These may be particularly efficient and cost-effective materials for reducing friction.

A hardness value of the solid lubricant particles may be greater than a hardness value of the body material. Hardness of the solid lubricant particles may be, for example, at least 10% greater, more preferably at least 20% greater, than hardness of the body material. This may reduce friction of the inner surface of the belt.

All, or at least 90% of the solid lubricant particles may be arranged to a depth of equal to or less than 50 μm, determined as a depth direction from the inner surface of the belt. If all, or substantially all, solid lubricant particles are on the inner surface of the belt, friction may be reduced cost efficiently.

The solid lubricant particles may have an average diameter from 2 μm to 30 μm, measured as the greatest diameter of each solid lubricant particle. This kind of particles may be used to reduce friction of the inner surface of the belt without affecting too much other properties of the belt. Further, all, or substantially all, solid lubricant particles may have a diameter from 2 μm to 30 μm, measured as the greatest diameter of each solid lubricant particle.

At least some adjacent solid lubricant particles may be spaced apart from each other. For example, at least 30% of the solid lubricant particles may be spaced apart from each other so that a distance between two adjacent solid lubricant particles is greater than the greatest diameters of said solid lubricant particles. The adjacent solid lubricant particles, when spaced from each other, may form spaces for oil lubricant. This may further lower friction in cases in which oil lubricant film breaks.

A binder may cover at least some of outer surfaces of the solid lubricant particles. The binder may cover, for example, at least 20% of the outer surfaces of the solid lubricant particles in order to bond the solid lubricant particles with the body material. If the solid lubricant particles have the binder forming a bond with a body material, e.g., with a polyurethane matrix, friction level of the inner surface of the belt may be more controllable than conventionally.

Thus, in an embodiment, at least some outer surfaces of the solid lubricant particles comprise a binder.

The binder may be an organic binder. The binder may be, e.g., an adhesive, which may be used for bonding at least some of the solid lubricant particles with the body material.

An arrangement for manufacturing the belt may comprise:

a rotatable casting cylinder, a movable applicator for applying a solid lubricant coating on to the casting cylinder, a casting unit for casting a body material on to the casting cylinder having the solid lubricant coating on its outer surface, and a unit for forming the reinforcing structure of the belt.

Thanks to the arrangement comprising, for example, the rotatable casting cylinder together with the movable applicator, properties of the obtained belt may be improved.

The solid lubricant particles may be used to increase roughness of the inner surface of the belt. This can have an effect on the friction properties of the inner surface of the belt. Further, adjacent solid lubricant particles may be spaced from each other, therefore forming spaces for oil lubricant. This may further lower friction in cases in which oil lubricant film breaks.

BRIEF DESCRIPTION OF THE DRAWINGS

The figures are illustrations which may not be in scale. Similar parts are indicated in the figures by the same reference numbers.

DESCRIPTION OF THE PREFERRED EMBODIMENTS

Figure 1A:
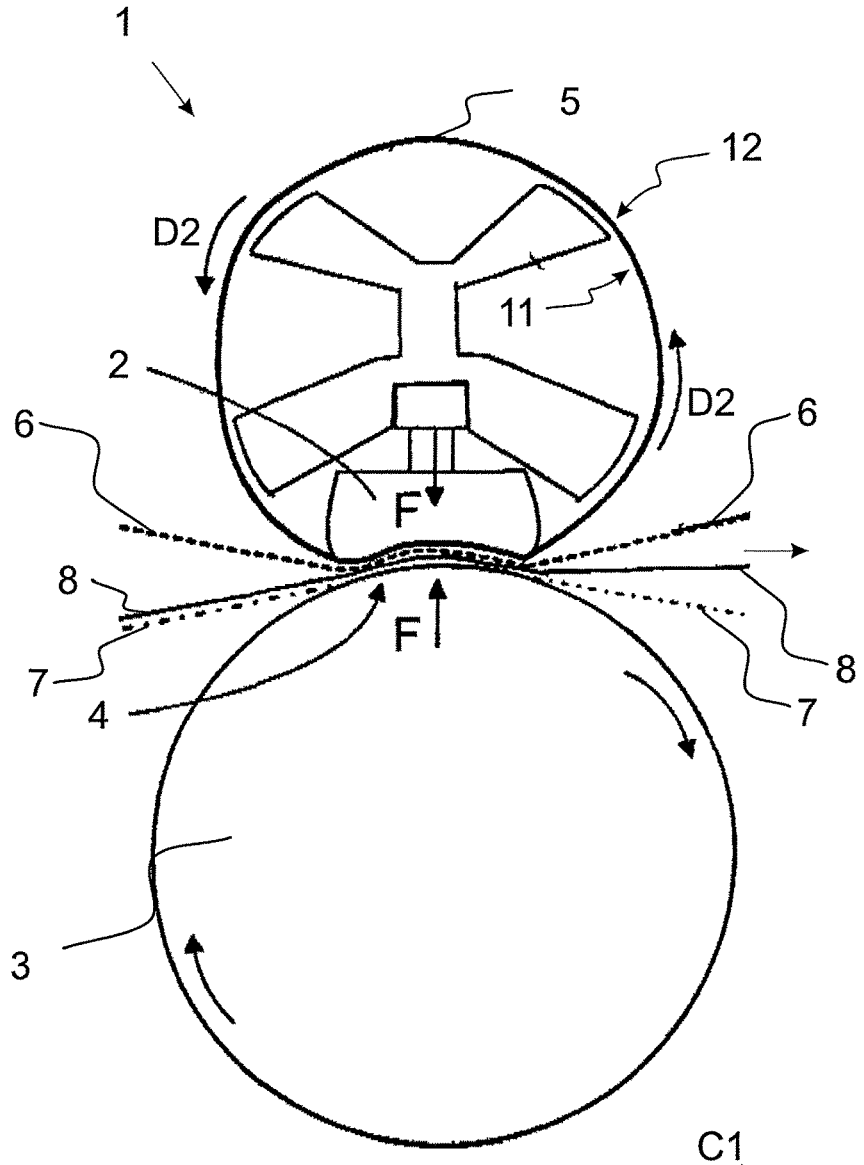
FIG. 1*a* illustrates an example of a shoe press.

All embodiments in this application are presented as illustrative examples, and they should not be considered limiting.

The following reference numerals are used in this application:

1 shoe press,
2 press shoe,
3 counter roll,
4 press zone,
5 belt,
5*a* thickness of a body of the belt,
6 first paper machine fabric, for example press felt,
7 second paper machine fabric,
8 fiber web,
9 wire,
10 inner surface,
11 outer surface,
14 body of the belt,
18 casting cylinder,
19 arrangement for manufacturing a belt,
20 casting unit,
21 body material,
22 applicator,
23 demolding agent,
24 solid lubricant,
25 unit for forming a reinforcing structure of the belt,
26 support structure,
27 spraying unit,
28 sprayed material,
29 solid lubricant particle(s),
dl greatest diameter of a solid lubricant particle 29,
30 space between adjacent solid lubricant particles,
31 first yarn layer of the reinforcing structure,
32 second yarn layer of the reinforcing structure,
50 grooves on the outer surface of the belt,
53 lands between the grooves,
60 attaching point of the belt,
100 sleeve roll,
102 support shaft of the sleeve roll,
110 curve element of the sleeve roll,
D1 first direction of the belt,
D2 second direction of the belt,
MD travel direction of the belt,
CD cross direction of the belt,
C1 first curve of the sleeve roll, and
C2 second curve of the sleeve roll.

Terms

In this application, the terms "travel direction" MD and "cross direction" CD are used. The travel direction MD refers to the direction of rotation of the belt in use. The cross-direction CD refers to the longitudinal direction, typically transverse to the travel direction MD of the belt 5. In use, the cross-direction is parallel to the axis of rotation of the belt.

In this application, the term "substantially parallel" means that one direction does not deviate from said substantially parallel direction by more than 10 degrees, most preferably not by more than 3 degrees. Thus, e.g., "substantially parallel to the travel direction" means, in this application, that a direction does not deviate from said travel direction by more than 10 degrees, and preferably not by more than 3 degrees.

The term "thickness" of the belt will be used, referring to the depth direction of the belt.

The term "belt" refers to a belt which is suitable for a sleeve roll and/or a shoe press of a paper, board, pulp, or tissue machine. Thus, the belt may be a shoe press belt or a sleeve roll belt.

The term "solid lubricant" refers to material that is able, in a solid phase, to reduce friction between two surfaces sliding against each other.

The term "solid lubricant particle" may refer to a small, localized object which may have a small amount of solid lubricant forming a particle. The particle may have a greatest diameter dl, for example, in a range between 1-100 μm.

Paper, Board, Pulp, and Tissue Machines

Typically, in paper, board, pulp and tissue machines, the fiber web is produced and treated in an assembly formed by several apparatuses arranged consecutively in a process line.

A typical production line comprises a forming section comprising a headbox and a wire, a press section comprising a felt, a drying section and, finally, a reel-up. Further, the production line typically comprises e.g., at least one winder for forming customer rolls.

In the forming section, a headbox is used to form the fiber web. Further, some water can be removed through at least one paper machine fabric, i.e., at least one forming wire. The water removal rate may be improved by using a sleeve roll comprising a belt.

In the press section, some of the water remaining after the forming section can be removed by using at least one paper machine fabric, i.e., a felt. The water removal rate may be improved by using a shoe press 1 comprising a belt.

Shoe Press

Shoe presses 1 may be used in a paper, board, pulp, or tissue machine. FIG. 1*a* illustrates a reduced view of an example arrangement of a belt 5 in a shoe press 1.

The shoe press 1 equipped with the belt 5 can be used for dewatering a fiber web 8. The shoe press 1 typically comprises a counter roll 3 and a press shoe 2, a press zone 4 being formed between them. Thus, an extended press zone, i.e., a so-called long nip, is formed between the press shoe 2 and the counter roll 3. The function of the shoe press 1 is typically to remove water from the fiber web 8.

The shoe press belt 5, at least one paper machine fabric 6, 7, preferably two paper machine fabrics 6, 7, and the fiber web 8 to be dewatered, are arranged to be run through the press zone 4 in the travel direction (MD). Said fiber web 8 is thus supported by at least one paper machine fabric 6, 7, such as a felt.

The shoe press belt 5 is or can be arranged in connection with the shoe press 1 in such a way that its outer surface 11 faces the fiber web 8 and its inner surface 10 faces the press shoe 2. One surface of the wet fiber web 8 is typically compressed by the rotating counter roll 3 while the other surface of the fiber web 8 is compressed by the press shoe 2 which is encircled by the shoe press belt 5 having a flexible body and the shape of a loop.

In operation, the shoe press belt 5 typically runs through the press zone 4 between at least one counter roll 3 and the press shoe 2. Advantageously, a paper machine fabric 6, preferably a press felt, is fitted, or is configured to be fitted, against the shoe press belt 5. On top of the press felt or corresponding paper machine fabric 6, 7, the fiber web 8 is conveyed through the shoe press 1 so that the outer surface 11 of the shoe press belt 5 is in direct contact with the paper machine fabric 6, preferably press felt, and the inner surface 10 of the shoe press belt 5 slides against the sliding surface of the press shoe 2.

Typically, the press shoe 2 and the counter roll 3 are pressed against each other in the press zone in such a way that the shoe press belt 5, at least one paper machine fabric 6, 7 and the fiber web 8 to be dewatered, all run in the nip between the press shoe 2 and the counter roll 3, are compressed. For example, the press felt is typically configured to be compressed in the press zone and to substantially reassume its initial thickness after the compression.

Sleeve Roll

Figure 1B:
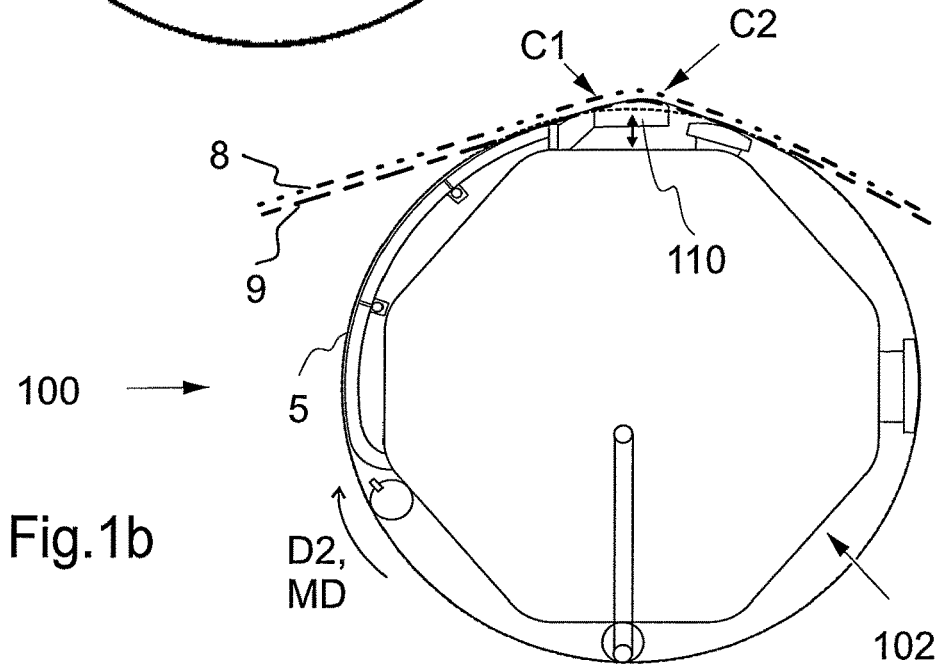
FIG. 1*b* illustrates an example of a sleeve roll.

FIG. 1*b* illustrates an example of a sleeve roll. The sleeve roll 100 equipped with a belt 5 can be used for dewatering a fiber web 8 on a wire 9.

The sleeve roll 100 can be located in the forming section for improving water removal therein. The sleeve roll 100 can be located e.g. in a bottom layer wire loop. The belt 5 may be arranged on a sleeve roll 100 which can be located e.g., at a wire section of a paper, board, pulp, or tissue machine. In an embodiment, the sleeve roll is used e.g., for joining layers of a multi-ply fiber web in a sleeve roll nip between the sleeve roll and the opposite wire of a twin-wire forming part.

The sleeve roll 100 can comprise a support shaft 102. The belt 5 is typically located around an outer surface of the sleeve roll 100. Thus, the belt 5 can be led to circle around the support shaft 102.

The belt 5 may be arranged in connection with the sleeve roll 100 in such a way that its outer surface 11 faces the fiber web 8 and its inner surface 10 faces the sleeve roll 100. Thus, the sleeve roll 100 can be encircled by the belt 5 having the shape of a loop.

Further, the sleeve roll 100 can comprise support elements located at a distance from each other on the support shaft 102. The belt 5, which can circle around the outer surface of the sleeve roll, can be supported by the support elements.

The sleeve roll 100 can further comprise a curve element 110. In operation, the belt typically runs through the dewatering zone on the curve element. The curve element 110 can cause increased forces which stretch the belt on the curve element 110. The curve element 110 may be movable, i.e., a radius of curvature of the belt on the on the surface of the curve element 110 can be controlled by moving the curve element 110 towards the center of the sleeve roll or outward from the outer surface of the sleeve roll. Thus, stretching of the belt 5 may vary from a normal rate to a very high rate.

A circumference of the belt may be increased and decreased during operating hours of the belt due to the movable curve element 110. Therefore, the belt may have high elasticity in order to be able to handle the stretching caused by the curve element 110 of the sleeve roll. Further, the belt may have good strength properties so that it does not break easily.

As discussed, the belt 5 may be led to circle around the stationary support shaft 102. Further, wire(s) 9 can be led via the curvilinear dewatering zone C1, C2, which dewatering zone can be supported by the belt 5.

The sleeve roll 100 can comprise at least one curvilinear dewatering zone C1, C2 comprising typically at least two partial curves C1, C2 such that the radius of curvature of a first partial curve C1 may be greater than the radius of curvature of a second partial curve C2 following the first partial curve in the travel direction MD of the belt. This can improve the water removal from the fiber web.

The curvilinear dewatering zone C1, C2 may be formed by the curve element 110 of the sleeve roll 100. The degree of curvature of the curve element 110 can increase in the travel direction of the belt 5 such that increasing dewatering pressure is applied to the fiber web 8 travelling e.g., between wires on said at least one curvilinear dewatering zone C1, C2 on the curve element 110. The curvilinear dewatering zone C1, C2 on the curve element 110 may contain several curves such that the radius of curvatures preferably decreases in the running direction of the wires. This can improve the water removal from the fiber web.

The sleeve roll 100 can comprise oil lubricant between the inner surface 10 of the belt 5 and the outer surface of the sleeve roll 100. Thus, the sleeve roll can comprise e.g., a lubricating pump(s), which can be used to pump lubricant into a gap between said belt 5 and the outer surface of the sleeve roll.

The curve element 110 may be moved between two or more than two positions. Therefore, the curve element 110 may be used for controlling the radius of curvature of the belt 5 on the curve element 110.

The first position of the curve element 110 may form a first surface on the curve element. The first surface may have the same radius of curvature as the surface near the curve element.

In the second position of the curve element 110, an outer surface of the curve element may be moved outward. Thus, the second position of the curve element 110 may form a second surface on the curve element. The second surface may have decreased radius of curvature, if compared to surfaces near the curve element.

In the second position of the curve element 110, the belt 5 may need to stretch due to the curve element 110. Further, if the curve element 100 is movable, the belt 5 may need to return to its original shape when the curve element is moved back to the first position. Thus, the belt 5 may need to have good elasticity as well as suitable strength properties.

As discussed above, the belt 5 can be arranged to run around the sleeve roll 100. The inner surface 10 of the belt 5 can slide against the outer surface of the sleeve roll 100. A fiber web 8 to be treated can be led to the belt 5, typically supported by one or more than one fabric, such as a wire 9.

Belt

The belt can have an inner surface 10, and an outer surface 11. The belt may comprise a reinforcing structure 31, 32. The belt may form a closed loop, i.e., the belt 5 can be shaped like an endless loop.

The belt 5 can have a length, a circumference, and a thickness. The thickness is the smallest dimension. The circumference and the length can be selected for adapting the belt to a sleeve roll 100 or to a shoe press 1. The circumference of the belt 5 is determined to be such that the inner diameter of the belt 5, when in operation, will be suitable for the purpose.

The belt 5 can be an impermeable belt. The belt 5 has a body 14 made of a body material 21. The body material may form the outer surface 11 of the belt, or at least part of the outer surface of the belt. The body material 21 may form part of the inner surface 10 of the belt.

In this application, the term "elasticity" refers to an ability of the belt to return to its original shape when a force is removed. Elasticity percentages (%) are values stating how much the belt can stretch elastically.

The belt may be configured to stretch elastically equal to or more than 1.5% in the travel direction of the belt so that it will return in its original length after the force stretching the belt has been removed. In an embodiment, the belt can be configured to stretch elastically in a range between 1.5% and 5.0%, more preferably from 2.0% to 4.0%, in the travel direction of the belt so that it will return in its original length after the force stretching the belt has been removed. Thus, the belt may have good stretchability and elasticity, at least in the travel direction of the belt. Thus, the belt may not be easily damaged. The belt 5 may further be bendable, i.e., the belt can be capable of being bent at least to a predetermined radius of curvature without breaking.

The length of the belt in the cross direction is determined according to the machine width and may be, for example, in a range between 1.5 m and 12.6 m.

The circumference of the belt 5, that is the length of one rotation, is determined to be such that the inner diameter of the belt 5, when in operation, will be suitable for the use. Circumferences of sleeve roll belts and shoe press belts may differ. An inner diameter of the belt may be in a range between 0.7 m and 3 m. In an embodiment, the inner diameter of the belt 5 is 0.7 to 2.5 m, more preferably 1.0 to 1.9 m, and most preferably 1.09 to 1.82 m.

In an embodiment, the circumference of the belt 5 is at least 2.2 m, more advantageously at least 3.0 m, and preferably at least 3.4 m. Furthermore, in this embodiment, the circumference of the belt is suitably not greater than 6.3 m, preferably not greater than 6.0 m, and more preferably not greater than 5.8 m.

The thickness 5*a* of the belt can be at least 1.5 mm, more preferably at least 2 mm, and most preferably equal to or more than 3 mm. Thus, it is possible to obtain suitable strength as well as e.g., arrange a reinforcing structure, such as yarns, into the belt. Furthermore, the thickness 5*a* of the belt can be equal or less than 7 mm, more preferably equal to or less than 5 mm, and most preferably equal to or less than 4 mm, for example in a range of 2.5 mm-5 mm. Said thickness together with materials of the belt can provide good strength properties for the belt.

Body of the Belt

The belt comprises a body 14. The body 14 can be made of a body material 21. Preferably, the belt 5 comprises an elastic body which has a capacity to reassume its initial shape after being compressed.

Thus, the belt 5 can comprise an elastic body in order to have a good elasticity. In this application, the term "elasticity" refers to an ability of the belt to return to its original shape after stretching or pressing.

The belt 5 can be made of materials, which are suitable for paper, board, pulp, and tissue machines, which do not harm a wire 9, a felt 7, or the fiber web 8, and which have suitable stretching and strength properties.

The body can comprise or consist of polymer(s). The body 14 may comprise or consist of elastomer material. The belt 5 may comprise an elastomer material as its main raw material.

The body 14 may comprise polyurethane. Preferably, the body 14 contains primarily polyurethane. Advantageously, the belt comprises at least 50 wt.-%, more advantageously at least 70 wt.-%, and preferably at least 80 wt.-% polyurethane, calculated from the total weight of the belt. Polyurethane may improve the properties of the belt, such as elasticity and bendability, and be particularly suitable for use in combination with the shoe press and the sleeve roll. Thus, the polyurethane may be used to obtain good strength and elasticity properties; hence, the belt may be able to stretch and bend during operating hours without breaking. Furthermore, the belt may comprise equal to or less than 99.9 wt.-%, more preferably equal to or less than 97 wt.-%, or equal to or less than 95 wt.-% polyurethane, calculated from the total weight of the belt. For example, e.g., the reinforcing structure 31, 32 and solid lubricant particles can comprise other material(s).

The body of the belt may have layer(s) composed of polyurethane having a specific composition and hardness, and having excellent physical properties of crack resistance, abrasion resistance, and bending fatigue resistance.

Methods for manufacturing polyurethane are known to a person skilled in the art. The manufacturing process of polyurethane may be based on a method of prior art. The polyurethane may be made, for example, by mixing a urethane pre-polymer having terminal isocyanate groups, with a chain extender, preferably a chain extender comprising amine groups (HN2-), OH groups, or mixtures of these.

Reinforcing Structure of the Belt

The belt may comprise a reinforcing structure 31, 32. The reinforcing structure can be a support structure supporting the body 14. The elasticity of the belt may need to be substantially high, hence, the reinforcing structure should not decrease the elasticity of the belt too much.

The reinforcing structure may comprise yarns. The term "yarn" refers to a long structure, which has relatively small cross section. The yarn can be composed of fibers and/or filaments, with or without twist. The yarn can be multiple plied yarn. The yarn can be based on synthetic polymer(s). The term "filament" refers to a fiber of great length.

The belt may have several yarns arranged in at least two directions, i.e., the first direction and the second direction. The first direction can be parallel or substantially parallel to a travel direction of the belt. The second direction can be parallel or substantially parallel to an axis of rotation of the belt.

Adjacent yarns in a layer may be either in contact with or bonded to each other, or they may be spaced from each other.

The yarns in different layers 31, 32 may be either in contact with or bonded to the yarns of the next layer, or they may be spaced from each other. Preferably, the reinforcing yarn layers 31, 32 on top of each other are separated from each other. Thus, the yarn layers do not have to be fastened to each other or bound to each other in any way. However, if the yarns in different layers are in contact with or bonded to the yarns of the next layer, strength properties of the reinforcing structure may be improved.

The yarns may be embedded in the elastic body. Thus, the yarns may be fully surrounded by the material of the body.

The yarns may comprise synthetic fibers having high strength, high modulus, and high elastic modulus. The yarns can comprise or consist of at least one of: polyamide (PA), e.g., nylon, polypropylene (PP), polyethylene (PE), rayon, viscose, polyester such as polyethylene terephthalate (PET), polyvinyl alcohol (PVA), polyaramide, polyphenylene sulfide (PPS), liquid crystal plastic (LCP), polyimide, and polyether ether ketone (PEEK). The yarns comprising or consisting of the above-mentioned materials can stiffen the belt, but still allow the necessary level of bending and stretching of the belt.

Outer Surface of the Belt

The outer surface 11 of the body 14 of the belt can be formed of the body material 21. The body material 21 may comprise or consist of polyurethane.

Figure 7:
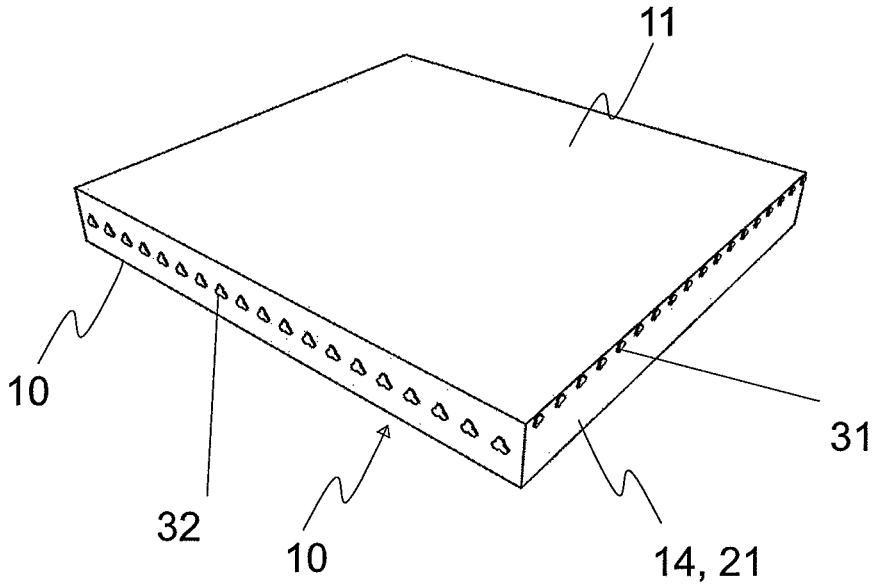

Referring to FIG. 7, the outer surface 11 of the belt may have a smooth surface. Particularly, outer surface of a sleeve roll belt is preferably smooth or substantially smooth. The belt 5 having the smooth outer surface may not have grooves, nor patterning, having a depth of more than 0.4 mm. Particularly, a smooth surface may not have any area of greater than 10 mm2 having a depth of more than 0.4 mm. The outer surface 11 of the belt may comprise a slight patterning, i.e., so-called buffing. The depth of the buffing on the outer surface 11 of the belt 5 may be, for example, 0 to 50 μm, or 3 to 30 μm. A suitable roughness of the outer surface of the belt may have advantageous effects on its action together with a paper machine fabric.

Figure 2A:
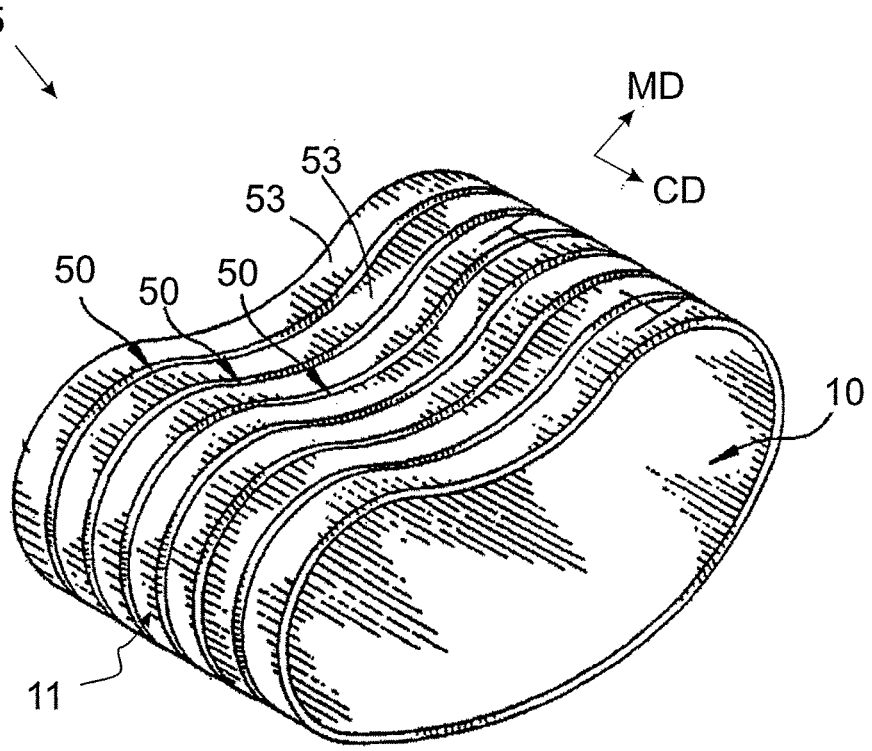
FIGS. 2*a-b* illustrate examples of a belt.

Referring to FIG. 2*a*, the outer surface 11 of the belt may comprise several parallel grooves 50, as well as ridges 53 between them in order to improve dewatering properties of the belt 5. Particularly, outer surface of a shoe press belt preferably comprises said grooves 50. The technical effect is to obtain improved water removal rate. The depth of a groove may be more than 0.4 mm, and preferably equal to or less than 2.0 mm, such as in a range between 0.5 mm and 1.5 mm, measured from the deepest point of the dewatering groove. The width of the dewatering groove 50 may be equal to or more than 0.5 mm and not greater than 2.0 mm. The distance between the central lines of two parallel adjacent dewatering grooves 50 may be at least 1.5 mm and not greater than 7.0 mm. The total water volume of the dewatering grooves 50 may be e.g., between 100 and 800 g/m2. The number of dewatering grooves 50 may be at least 140/m, more advantageously at least 200/m and advantageously not greater than 670/m. With the above-mentioned features of the dewatering grooves 50, water can be removed from the web more efficiently via said dewatering grooves 50: These benefits are typically realized the better, the more of above-mentioned features are implemented in the belt 5.

Solid Lubricant

The inner surface 10 of the belt 5 comprises a solid lubricant in a form of solid lubricant particles 19.

The solid lubricant can be applied as an aqueous coating. The coating may comprise solvent. The solvent may be evaporated-during manufacturing process of the belt. The solvent may comprise an alcohol, for example an ethylene glycol ($C_2H_4(OH)_2$). The coating may further comprise a binder. The binder may comprise, e.g., an aliphatic and/or aromatic diisocyanate.

The solid lubricant may be applied as an aqueous coating on a casting cylinder 18. In an embodiment, the body of the belt is manufactured first, after which the solid lubricant is sprayed onto the inner surface of a belt.

The aqueous coating may have a dry solid content in a range between 1% and 50%.

The coating comprising the solid lubricant 24 can be dried on the casting cylinder 18. When the coating has been dried on the casting cylinder 18, the dried solid lubricant can form solid lubricant particles 19 on the casting cylinder. The dried solid lubricant may have a dry solid content in a range between 80% and 100%.

The solid lubricant particles can be substantially spherical particles. The solid lubricant particles may be, for example, oval shaped particles. Said substantially spherical shape may be advantageous for reducing friction between the belt and the installation surface.

The solid lubricant particles may have a suitable diameter to be able to reduce a friction. At least 90% of the solid lubricant particles 29 may have a diameter of equal to or more than 2 μm, preferably equal to or more than 4 μm, more preferably equal to or more than 6 μm, and most preferably equal to or more than 10 μm, determined from the greatest diameter of each particle. Further, at least 90% of the solid lubricant particles 29 may have a diameter of equal to or less than 40 μm, preferably equal to or less than 30 μm, more preferably equal to or less than 25 μm, and most preferably equal to or less than 20 μm, determined from the greatest diameter of each particle.

In order to reduce friction efficiently, an average diameter of the solid lubricant particles 29 may be equal to or more than 2 μm, preferably equal to or more than 4 μm, more preferably equal to or more than 6 μm, and most preferably equal to or more than 10 μm, determined from the greatest diameter of each formed particle. Further, the average diameter of the solid lubricant particles 29 may be equal to or less than 40 μm, preferably equal to or less than 30 μm, more preferably equal to or less than 25 μm, and most preferably equal to or less than 20 μm, determined from the greatest diameter of each formed particle.

All, or at least 90% of the solid lubricant particles can be arranged to a depth of equal to or less than 50 μm, determined as a depth direction from the inner surface of the belt. Thus, the solid lubricant particles are preferably arranged to a depth in a range between 0 μm and 50 μm determined in the depth direction from the inner surface of the belt.

Hardness of the solid lubricant particles 29 can be greater than hardness of the body material 21, such as e.g., at least 20% harder than hardness of the body material. This may decrease friction between the belt and its installation surface.

The solid lubricant particles 29 may form a heterogenous or homogenous layer on the inner surface of the belt. At least some solid lubricant particles are on the inner surface of the belt, hence, they may be only partially surrounded by the body material. However, due to manufacturing methods, some solid lubricant particles may be fully surrounded by the body material.

The solid lubricant particles may form a heterogenous or homogenous layer having a thickness in a range between 0.002 mm and 0.2 mm, preferably equal to or less than 0.2 mm, more preferably equal to or less than 0.15 mm, most preferably equal to or less than 0.12 mm. Thus, it is possible to reduce efficiently friction between the belt and its installation surface.

The solid lubricant particles, or at least some adjacent solid lubricant particles, can be spaced apart from each other. For example, at least 20%, preferably at least 30%, more preferably at least 40%, and most preferably at least 50% of the solid lubricant particles may be spaced apart from each other so that a distance between two adjacent solid lubricant particles is from 10 μm to 500 μm. The adjacent solid lubricant particles, when spaced from each other, may form spaces for oil lubricant. This may further lower friction in cases in which oil lubricant film breaks. Thus, the roughness of the inner surface of the belt may be increased. Furthermore, some oil lubricant may stay in the spaces 30 between adjacent solid lubricant particles. This may substantially decrease friction in case the oil lubrication film breaks.

An amount of the solid lubricant particles in the inner surface of the belt can have an effect on friction properties. The solid lubricant particles may cover at least 2% from the area of the inner surface of the belt. Preferably, the solid lubricant particles cover at least 5%, more preferably at least 10%, and most preferably at least 15% from the total area of the inner surface of the belt. Further, the solid lubricant particles may cover equal to or less than 99% from the total area of the inner surface of the belt. Preferably, the solid lubricant particles cover equal to or less than 85%, more preferably equal to or less than 70%, and most preferably equal to or less than 50% from the total area of the inner surface of the belt. Thanks to said amount of the solid lubricant particles, friction between the belt and the installation surface may substantially decrease in use, without affecting too much other properties of the belt.

Preferably, only the inner surface 10 of the belt comprises said solid lubricant particles 29, and the outer surface of the belt as well as the middle of the belt are free from the solid lubricant particles 29. This may reduce manufacturing costs of the belt. Further, the solid lubricant particles may not have many positive effects in the middle of the belt.

The coating comprising the solid lubricant can be selected to be a sprayable or mechanically applicable coating that dries on an outer surface of the casting cylinder and/or on the inner surface of the belt.

The solid lubricant particles may comprise or consist of a fluoropolymer. Preferably, the solid lubricant particles comprise, consist of, or mainly consist of a 2-component solid lubricant.

The solid lubricant particles may be selected from a group comprising or consisting of:

- polytetrafluoroethylene (PTFE),
- molybdenum disulfide ($MoS_2$),
- graphite,
- indium,
- lead,
- tin,
- titanium dioxide,
- calcium carbonate (PCC, GCC), and
- plastic, such as polypropylene, polyethylene, and/or polyethylene terephthalate.

Preferably, the solid lubricant particles are selected from a group comprising or consisting of:

- polytetrafluoroethylene (PTFE),
- molybdenum disulfide ($MoS_2$), and
- graphite.

These materials may reduce friction at high temperatures e.g., at least up to 350° C.

In an embodiment, the solid lubricant comprises polytetrafluoroethylene. In this embodiment, an amount of the polytetrafluoroethylene (PTFE) is preferably in a range between 5 wt. %-100 wt. %, more preferably in a range between 10 wt.-% and 50 wt. %, and most preferably in a range between 15 wt. % and 40 wt. %, determined from a total dry weight of the solid lubricant particles. Polytetrafluoroethylene (PTFE) can be used to decrease a friction between the belt and the installation surface of the belt efficiently. Furthermore, polytetrafluoroethylene (PTFE) is able to handle high temperatures.

Friction between a belt and its installation surface, particularly if the belt has substantially smooth inner surface, may be extremely high in cases wherein the uniformity of the lubricating oil film breaks. Thanks to the solid lubricant particles 29, a friction between the belt and its installation surface may be reduced. Thus, the belt may not be broken as easily as conventionally.

In an embodiment, the solid lubricant has a color that is visually perceptible from the color of the belt. This enables, among other things, examining the evenness of the solid lubricant coating on the inner surface of the belt. Thus, it is possible to notice any problem areas in the coating.

In an embodiment, a color of the solid lubricant is visually perceptible from a color of an outer surface of a casting cylinder in order to examine the evenness of lubricant distribution before casting the body material. Thus, it is possible to notice any problem areas in the coating before casting the body material on the solid lubricant coating.

The coating may further comprise a binder. During a manufacturing process of the belt, the binder may be attached onto outer surfaces of the solid lubricant particles. Thus, the outer surfaces of the solid lubricant particle may comprise the binder. The binder may be used to bond the solid lubricant particles with the body material.

As discussed, the binder may cover at least some of outer surfaces of the solid lubricant particles. The binder may cover, for example, at least 20%, preferably at least 30%, more preferably at least 40%, and most preferably at least 50% of the outer surfaces of the solid lubricant particles in order to bond the solid lubricant particles with the body material. If the solid lubricant particles have the binder, friction level of the inner surface of the belt may be more controllable than conventionally.

The binder may comprise, for example, aliphatic diisocyanate (ADI) and/or aromatic diisocyanate, such as toluene diisocyanate (TDI) and/or methylene diphenyl diisocyanate (MDI).

Diisocyanates, such as ADI, can be used to make durable adhesive for binding the solid lubricant particles with a body material, particularly with body materials comprising polyurethane.

A total amount of the binder(s) may be in a range between 5 wt. %-30 wt. %, more preferably in a range between 7 wt.-% and 20 wt. %, determined from a combined dry weight of the binder and the solid lubricant particles. Thus, the binder may efficiently attach the solid lubricant particles to the body material.

Thanks to the binder, the solid lubricant particles can be bonded with the body material. Thus, the belt may comprise solid lubricant particles 29, which are bonded with a polyurethane matrix. Addition of the solid lubricant 24 may substantially improve friction properties of the belt, and addition of the binder may substantially improve controllability of the friction properties.

It was surprisingly found out that the solid lubricant may form a layer able to bond efficiently with the body material so that the resulted coating layer may have suitable properties for the belt while reducing a friction between the belt and an installation surface. The solid lubricant may stay firmly attached to the body material over a time. Moreover, the solid lubricant particles may have spaces 30 between adjacent particles so that some oil lubricant can stay between the solid lubricant particles, thereby reducing a friction between the belt and an installation surface, particularly if the oil film otherwise disappears.

Inner Surface of the Belt

The belt 5 has an inner surface 10. The inner surface 10 of the belt 5 comprises solid lubricant 24 particles 29. The particles 29 of the solid lubricant may be distributed at least mainly on the inner surface of the belt. The solid lubricant 24 may lower friction between the inner surface of the belt and an installation surface of the belt in use.

Roughness value of the inner surface of the belt can be in a range between 0.20 μm and 6 μm, preferably in a range between 0.30 μm and 5 μm, more preferably in a range between 0.40 μm and 4 μm, and most preferably in a range between 0.40 μm and 3 μm, determined according to standard ISO 4287:1997.

Roughness value of the inner surface of the belt, determined in a cross direction, can be in a range between 0.20 μm and 6 μm, preferably in a range between 0.30 μm and 5 μm, more preferably in a range between 0.40 μm and 4 μm, and most preferably in a range between 0.40 μm and 3 μm, determined according to standard ISO 4287:1997. Further, roughness value of the inner surface of the belt, determined in a machine direction, can be in a range between 0.20 μm and 6 μm, preferably in a range between 0.30 μM and 5 μm, more preferably in a range between 0.40 μm and 4 μm, and most preferably in a range between 0.40 μm and 3 μm, determined according to standard ISO 4287:1997. Thus the solid lubricant particles can create a roughness which may lower friction between the belt and its installation surface, particularly if an oil lubricant film disappears.

Said roughness of the inner surface of the belt may be formed, at least mainly, by the solid lubricant particles. The roughness can have a substantial effect on the durability of the belt. For example, in a case of broken uniformity of the lubricating oil film, the belt having the solid lubricant particles on the inner surface 10 may not be as easily damaged as a belt having a smooth inner surface. In other words, without the solid lubricant particles, the belt might, after breaking of the uniformity of the lubricating oil film, have a strongly decelerating effect due to the smooth surfaces, which may result in a permanent deformation in the belt.

Figure 4:
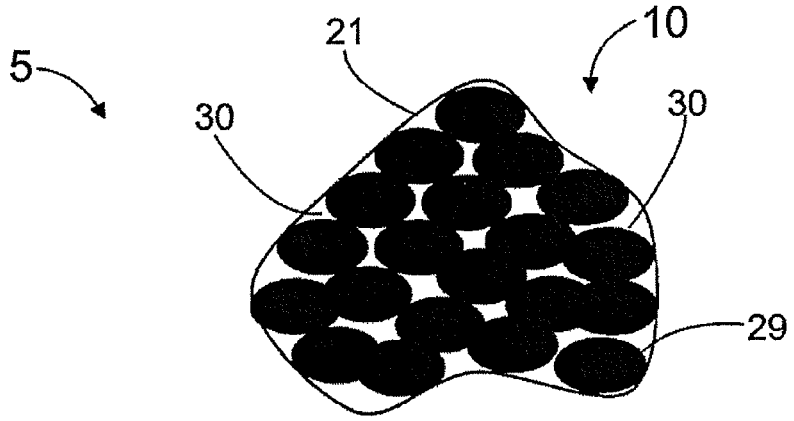
FIGS. 4-7 illustrate some example structures of belts.
Figure 5:
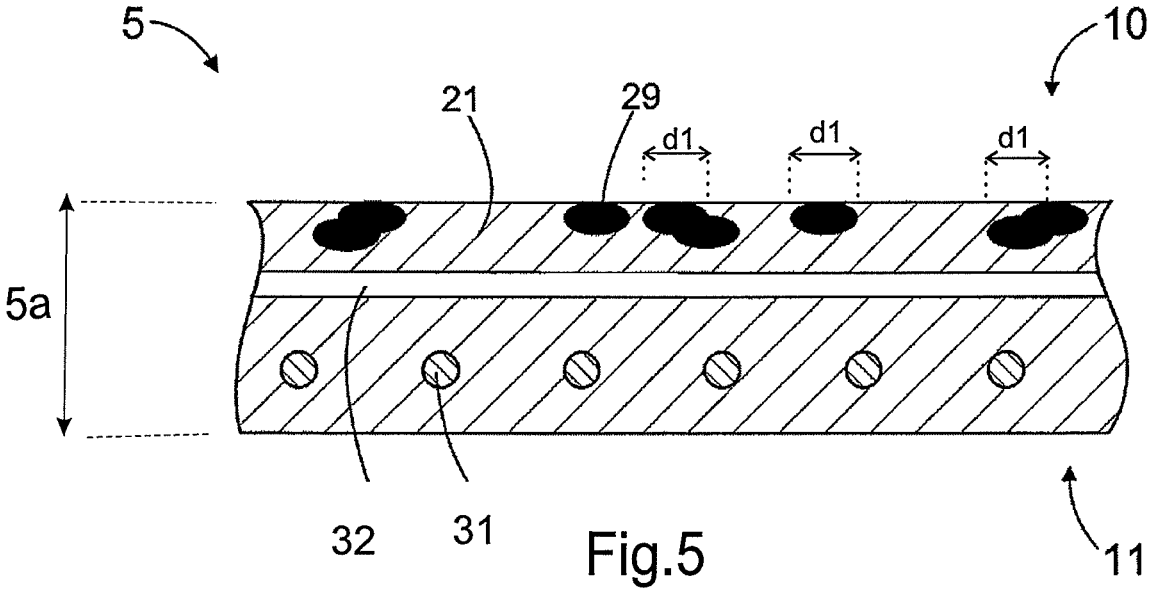
Figure 6:
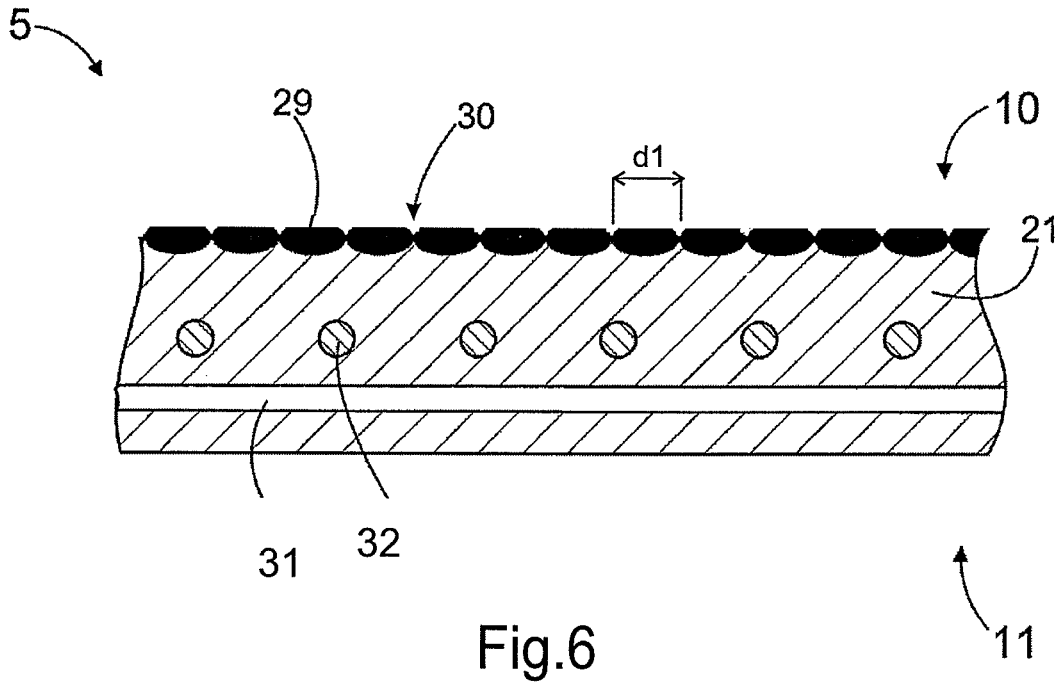

Referring to FIGS. 4-6, the belt may comprise the inner surface 10 comprising the solid lubricant particles 29.

The particles 29 of the solid lubricant 24 may be at least partly surrounded by the binder. Further, referring to FIG. 6, the particles 29 of the solid lubricant 24 may be partly surrounded by the body material 21. Further, as can be seen e.g., from FIGS. 5-6, the outer surface 11 of the belt can be free from the solid lubricant particles.

Referring to FIG. 5, the particles 29 of a solid lubricant 24 may be distributed unevenly on the inner surface of the belt. The solid lubricant particles may form the inner surface of the belt together with the body material so that the inner surface comprises the solid lubricant particles and the body material. Thus, the belt material 21 may surround at least partly at least some of the solid lubricant particles 29. Some of the solid lubricant particles 29 may be fully surrounded by the belt material 21. However, the solid lubricant particles 29 form at least part of the inner surface of the belt in order to be able to affect the friction properties of the belt.

Referring to FIGS. 4 and 6, in an embodiment, the solid lubricant particles may form, at least mainly, the inner surface of the belt. The belt material 21 can be disposed mainly below the particles 29 of the solid lubricant.

Thus, the body material 21 may not form the innermost surface of the belt but there may be solid lubricant particles 29 forming at least part of the innermost surface of the belt. Further, there may be spaces 30 between adjacent solid lubricant particles 29. Thanks to the spaces 30 between adjacent particles of the solid lubricant 29, roughness of the inner surface of the belt may be improved. Further, thanks to the spaces 30, some lubricating oil may be between the particles (in use), which may further reduce the risk of damaging the belt in use. Thus, in use, at least some spaces 30 between adjacent particles of the solid lubricant can comprise lubricating oil.

The lubrication oil between the shoe press and the belt, or between the sleeve roll and the belt, may be broken. As a result, the belt may become subject to high shear stress, which may cause a crack in the belt, from which the belt may start to delaminate. In addition, it is possible that a local elongation is formed in the belt, which may destroy the belt very rapidly. The novel belt may reduce the risk of such belt damage. Furthermore, the solid lubricant may cover defects arising during the manufacture of the inner surface of the belt. Thanks to the arrangement and the method, roughness level of the inner surface of the belt may be increased.

The solid lubricant particles may have a significant function in finishing the structure of the inner surface of the belt. The solid lubricant particles may form a homogenous or heterogeneous layer on the inner surface of the belt.

Arrangement for Manufacturing a Belt

Figure 3:
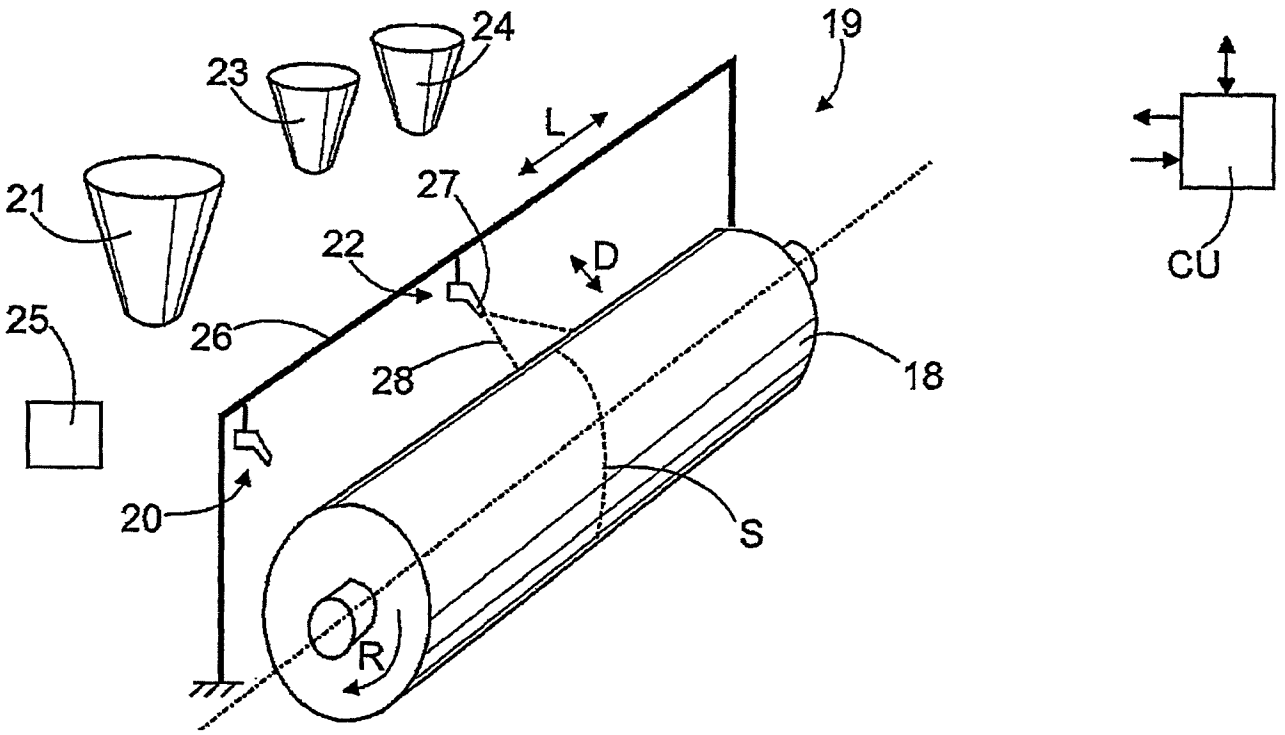
FIG. 3 illustrates an example of an arrangement for manufacturing a belt.

Referring to FIG. 3, an arrangement 19 for manufacturing the belt can comprise a casting cylinder 18. Preferably, the casting cylinder 18 is rotatable so that it can be rotated on its axis.

An outer surface of the casting cylinder 18 may be smooth or substantially smooth. The technical effect is to improve easiness of the manufacturing process and, particularly, to detach the belt from the casting cylinder without causing defects on the inner surface of the belt. If the outer surface of the casting cylinder is smooth, the belt may be easily removed from the surface of the casting cylinder. Furthermore, the belt may be detachable from the smooth casting cylinder earlier than from non-smooth surfaces. This may improve, production efficiency.

The arrangement 19 may further comprise an applicator 22 for applying a demolding agent 23 and/or the solid lubricant 24 onto the casting cylinder 18 before applying the body material.

The arrangement 19 may further comprise a casting unit 20 for applying the body material 21. In an embodiment, the casting unit 20 can be arranged to be movable along a direction parallel to the axis of the casting cylinder.

The solid lubricant 24 may be applied by a suitable coating method. The solid lubricant may be applied e.g., by spraying the particles onto the casting cylinder. This may be particularly efficient method with good controllability.

It may be easiest to implement the coating by spraying, which makes it possible to ensure an even coating throughout. The applicator 22 may comprise e.g., a spraying unit 27 for spraying 28 the solid lubricant onto the casting cylinder, for example onto a demolding agent therein. The spraying unit 27 can comprise a nozzle. The nozzle may have an effect on the properties of the formed coating layer.

A pressure of the spraying unit 27 can be controlled e.g., by a control unit (CU). The control unit (CU) can further be arranged to control a distance between the applicator 22 and the casting cylinder 18. Still further, the control unit may be arranged to control an angle in which the solid lubricant particles are applied on to the casting cylinder 18.

The arrangement may further comprise a support structure 26 arranged to support the applicator 22 and/or the casting unit 20. Alternatively, or in addition, the arrangement may comprise e.g., a robot arranged to move the applicator 22 and/or the casting unit 20.

The applicator 22 can be arranged to be movable along a direction parallel to the axis of the casting cylinder. Thus, the applicator 22 may comprise, for example, an oscillating actuator. In this embodiment, the oscillating actuator may be controlled by the control unit. Furthermore, the oscillating actuator may comprise, e.g., the nozzle.

The applicator 22 may be moved along the length of the support structure in a direction parallel to the axis of the casting cylinder during application of the solid lubricant. Further, the casting cylinder 18 may be rotated during the application of the solid lubricant. Rotation speed of the casting cylinder as well as the speed of the applicator may have an effect of properties of the inner surface of the obtained belt. In this embodiment, if the applicator is moved while the casting cylinder is rotated, it is possible to provide a spiral-like coating layer Thus, the casting cylinder 18 may be rotatable on its axis during the application of the solid lubricant. The solid lubricant may be applied by an applicator 22 that moves along the direction of the axis of the cylinder. By controlling the rotation speed of the casting cylinder and the speed of the applicator 22, it is possible to affect properties of the inner surface of the belt.

The arrangement 19 may further comprise a unit 25 for forming the reinforcing structure of the belt. The reinforcing structure may be formed e.g., after casting the body material, before curing the body.

By controlling rotation speed of the casting cylinder 18, speed of the applicator 22, and/or distance between the applicator and the casting cylinder, (e.g., a distance between a location of a nozzle of the applicator and an outer surface of the casting cylinder), it can be possible to affect density and/or location of the formed coating, as well as size of formed particles, and, hence, properties of the inner surface of the belt.

The control unit (CU) can be arranged to control e.g., rotation speed of the casting cylinder 18, speed of the applicator, and/or a location of a nozzle of the applicator.

The rotation speed of the casting cylinder 18, speed of the applicator 22, and/or a distance between the applicator and the casting cylinder, can be controlled by using one or more than one control unit (CU) or control device.

The coating of the inner surface of the belt may also protect the inner surface of the belt by covering any defects which may otherwise be in the inner surface of the belt, such as air bells extending to the surface, which might cause the inner surface of the belt to delaminate during operation.

Method for Manufacturing a Belt

A method for manufacturing a belt for a paper, board, pulp, or tissue machine may comprise the following steps:

applying a coating comprising a solid lubricant 24 on to a casting cylinder 18, drying the coating comprising the solid lubricant 24, thereby obtaining solid lubricant particles 29 on the casting cylinder 18, casting a body material 21 onto the casting cylinder 18 in order to form the body 14 on the solid lubricant particles 29, providing the reinforcement structure 31, 32 of the belt, and optionally, curing the body material, thereby obtaining the belt in which the solid lubricant particles forms at least part of the inner surface of the belt.

The method may also comprise the following step:

applying a demolding agent on the casting cylinder 18 before applying the coating comprising solid lubricant.

Furthermore, the step of providing the reinforcement structure may comprise a step of using a unit 25 for forming the reinforcing structure of the belt in order to provide the reinforcement structure into the belt.

The applied solid lubricant can be dried before casting the body material 21 onto the casting cylinder 18. The applied solid lubricant may be dried, e.g., by using a dryer, such as an oven. Alternatively, the applied solid lubricant may be dried, e.g., by letting the solid lubricant dry on the surface of the casting cylinder e.g., at a room temperature.

Preferably, the solid lubricant is dried by letting the solid lubricant dry from 1 hr. to 2 hr. before casting the body material. Thus, the step of drying the coating comprising the solid lubricant may comprise; letting the solid lubricant dry from 1 hr. to 2 hr., e.g., at a room temperature, before casting the body material.

After the step of drying the coating comprising the solid lubricant, the solid lubricant may have a dry matter content in a range between 80% and 100%. Thus, the solid lubricant may have a dry matter content in a range between 80% and 100% when the body material 21 is casted on the solid lubricant.

The demolding agent, if used, may form a substantially even layer on the casting cylinder. The demolding agent is preferably dried before the solid lubricant is applied. The demolding agent can be dried by using a dryer. Alternatively, the demolding agent can be dried by letting the demolding agent dry e.g., at the room temperature.

After forming the solid lubricant layer on the casting cylinder, the belt may be formed in manners known per se. The belt may be manufactured, after forming the solid lubricant layer on the casting cylinder, e.g., by providing several support yarns, shaping a body for a belt by casting an elastomer material comprising polyurethane against a mold surface, optionally, curing the material; and optionally, providing the outer surface of the frame with several grooves.

If the demolding agent is used between the solid lubricant and the casting cylinder, the formed belt may be easily removed from the surface of the casting cylinder. Demolding agents are known to a person skilled in the art.

If the demolding agent is used, it may be very difficult to add any kind of solid lubricant particles onto the inner surface of a belt after forming the body of the belt. Thanks to the novel solution, the solid lubricant can be added onto the inner surface of the belt during manufacturing process of the body of the belt. Thus, the demolding agent may not prevent the solid lubricant to be bonded mechanically and/or chemically onto the inner surface of the belt during manufacturing process of the body. The solid lubricant particles may be bonded with the body material, for example, by using one or more binders.

Figure 2B:
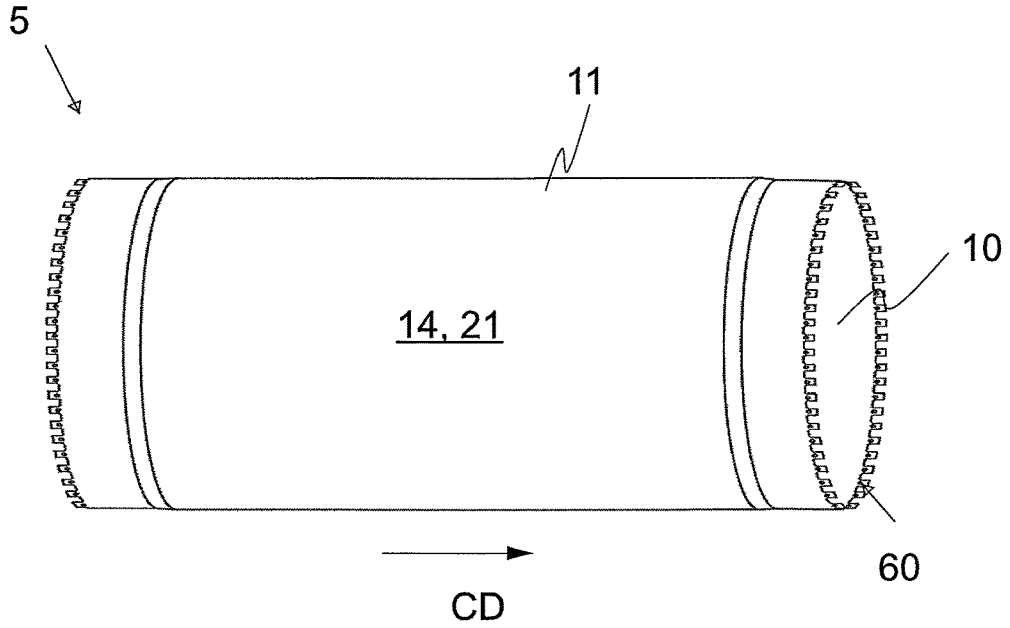

The belt can be intended to be installed on a sleeve roll or a shoe press of a board machine, a paper machine, a pulp machine, or a tissue machine. Referring to FIG. 2*b*, the belt may further comprise e.g., plurality of attaching points 60 of the belt for an installation of the belt.

Thanks to the solid lubricant particles 29, at least some properties of the belt may be improved. The solid lubricant may have an effect on surface roughness of the inner surface. Further, the particles of the solid lubricant may have an effect on hardness of the inner surface. Furthermore, the solid lubricant may have an effect on friction between the belt and the installation surface onto which the belt has been installed. Moreover, the inner surface of the belt may have spaces between adjacent particles. In use, said spaces may comprise oil lubricant, which may further reduce the friction.

The solid lubricant particles may substantially affect a friction between the belt and the installation surface of the belt. Thanks to the novel solution, in a case of broken uniformity of the lubricating oil film, a belt may not be as easily damaged as a belt having a smoother inner surface.

Example I

Novel belts having solid lubricant particles were manufactured. Further, similar reference belts without the solid lubricant particles were manufactured.

Figure 8A:
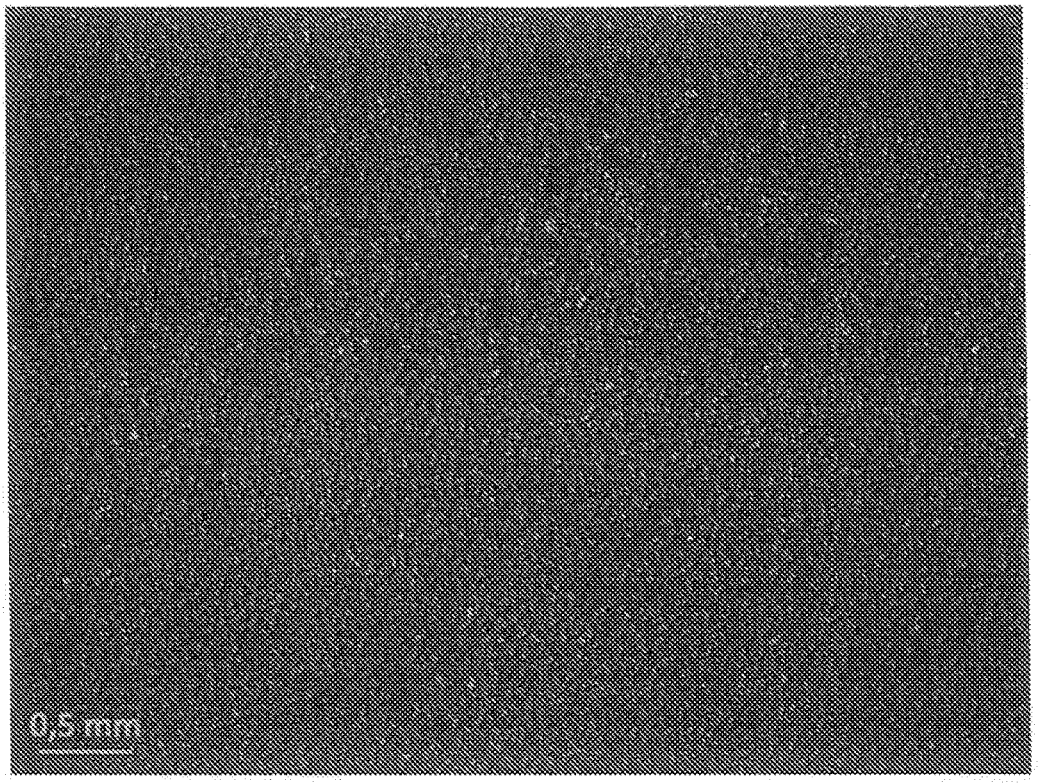
FIGS. 8*a*-10*b* show microscope images from experimental tests.
Figure 8B:
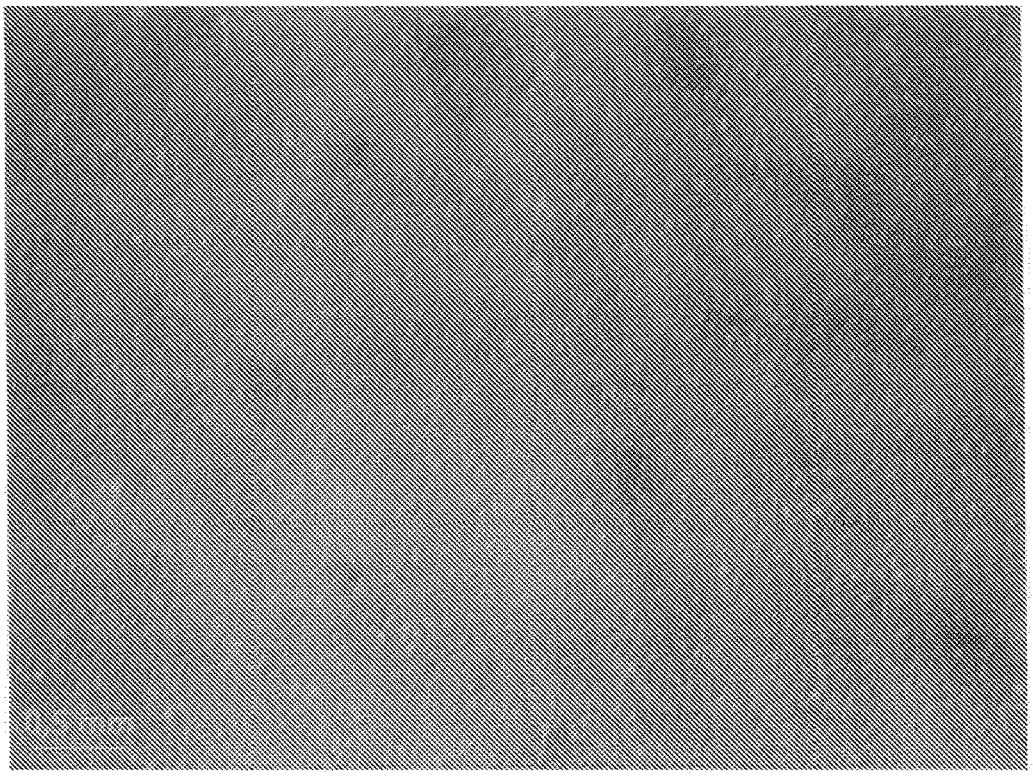

FIGS. 8*a*, 8*b*, 9*a*, 9*b*, 10*a*, and 10*b* show images from the experimental tests. FIGS. 8*a-b* are stereo microscope images. FIGS. 9*a-b* and 10*a-b* are electron microscope images. The scale of each image is shown.

Figure 9A:
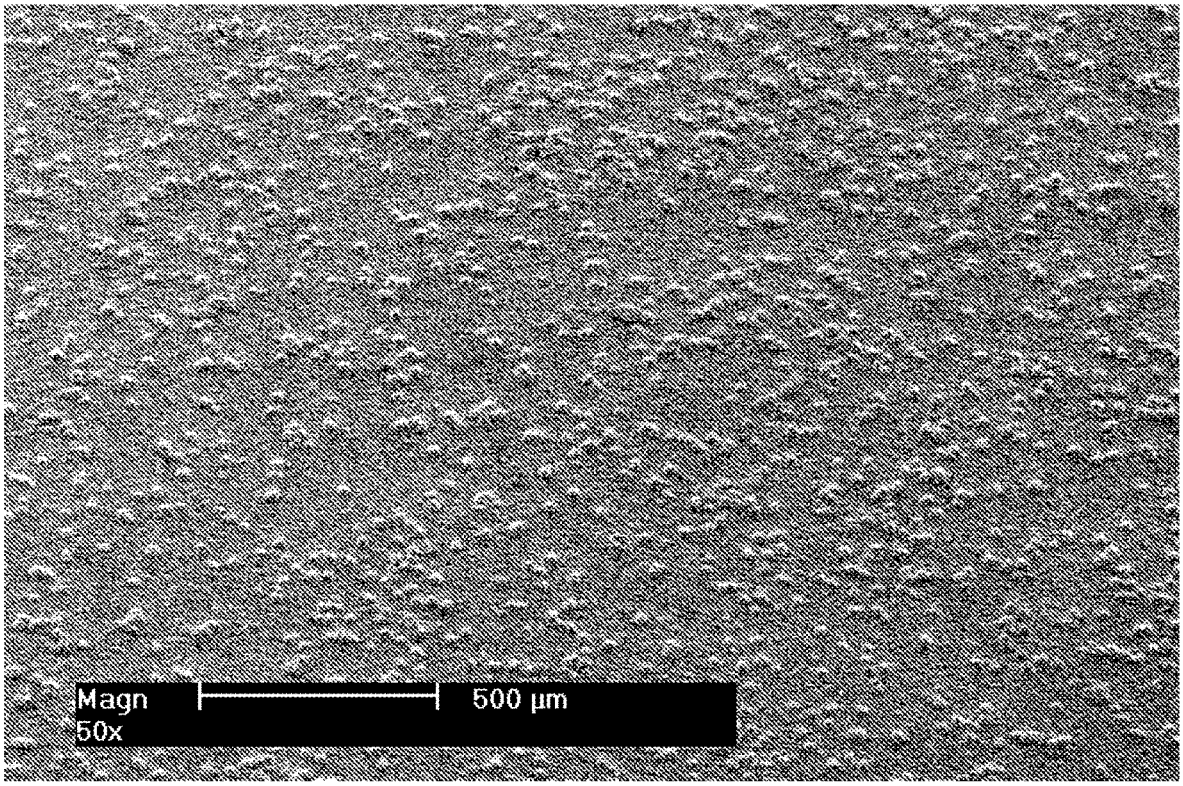
Figure 9B:
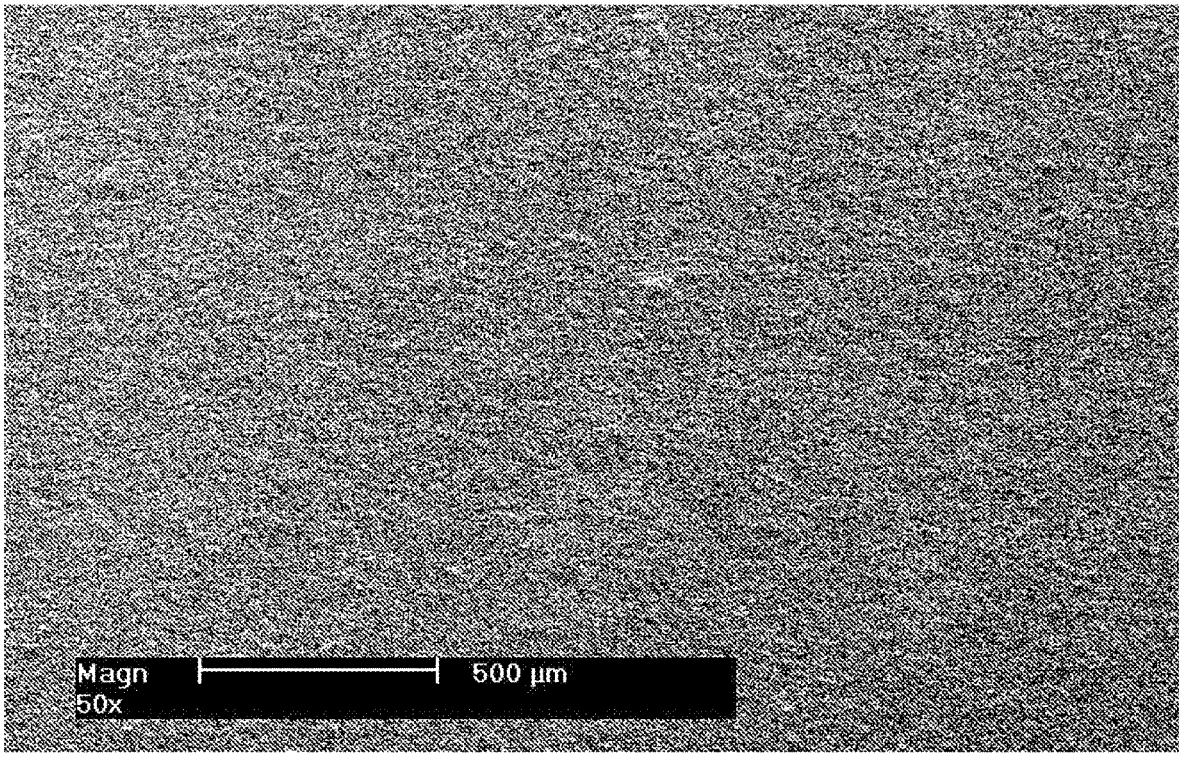
Figure 10A:
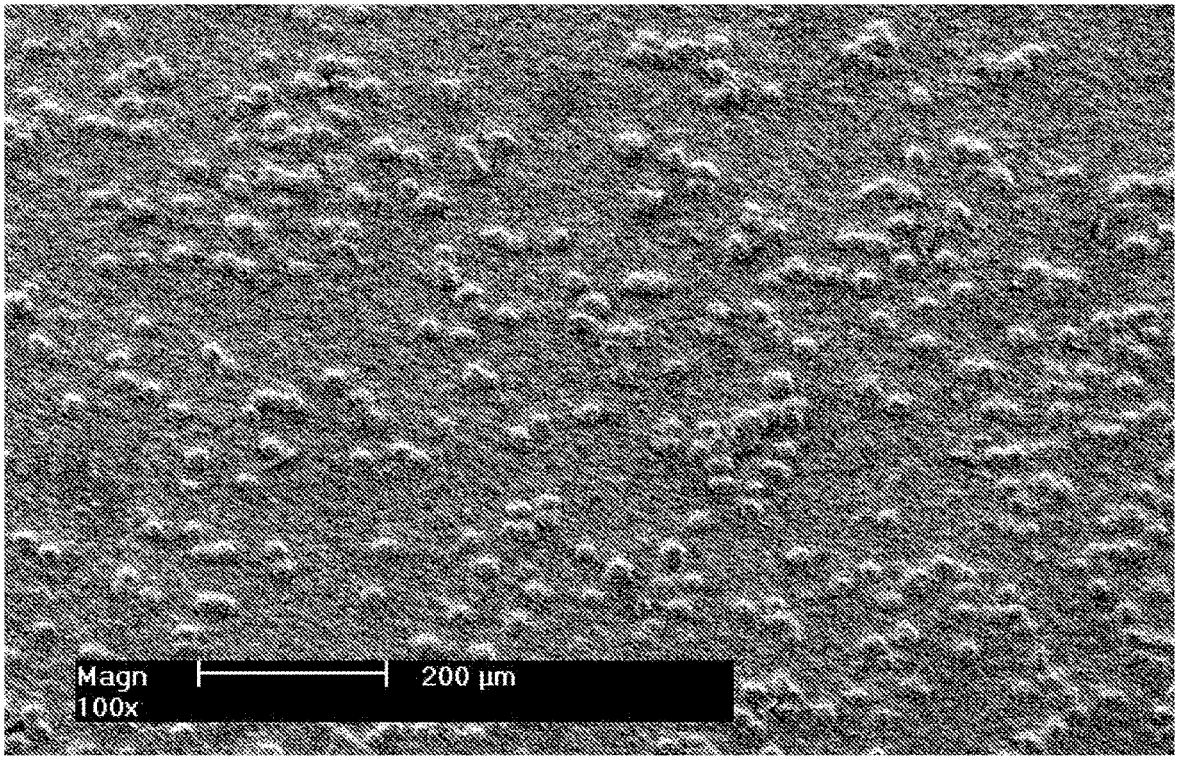
Figure 10B:
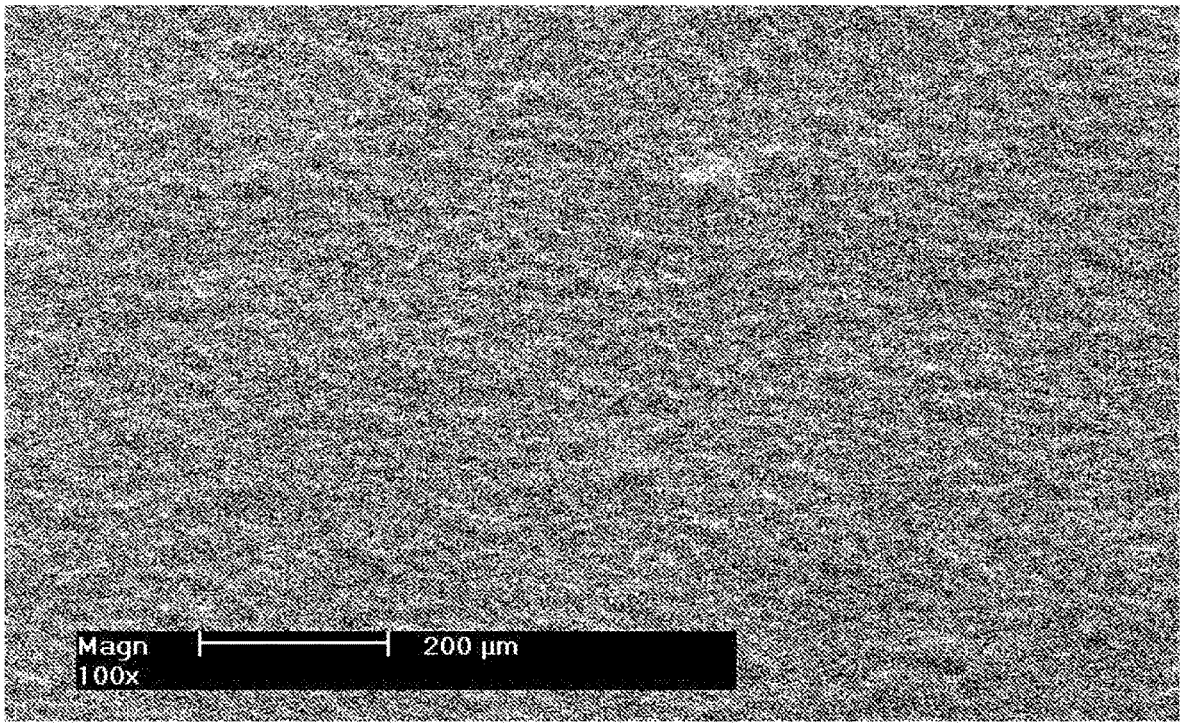

As can be seen from the images, the solid lubricant particles had a clear effect on the surface structures. FIGS. 8*a*, 9*a* and 10*a* show samples having larger solid lubricant particles and FIGS. 8*b*, 9*b* and 10*b* show samples having smaller solid lubricant particles. Both samples were able to reduce friction of the inner surfaces of the belts.

A roughness levels of the inner surfaces were tested during experimental tests.

Several samples comprising the solid lubricant particles and having a roughness level in a range between 0.2 μm and 6 μm were manufactured. Roughness level of reference samples were in a range between 0.04 μm and 0.9 μm.

All samples having the solid lubricant particles on the inner surface of the belt had reduced friction. Friction levels of every sample according to this specification having the solid lubricant particles were at least 50% lower than friction levels of the reference samples. Best results were obtained with A-samples and B-samples having roughness level in a range between 0.40 μm and 3 μm. Roughness values of A-samples (FIGS. 8*a*, 9*a*, 10*a*) were in a range between 1 μm and 3 μm. Roughness values of B-samples (FIGS. 8*b*, 9*b*, 10*b*) were in a range between 0.40 μm and 0.9 μm.

The invention has been described with the aid of illustrations and examples. The invention is not limited solely to the above presented embodiments but may be modified within the scope of the appended claims.

I claim:

1. A belt for a paper, board, pulp, or tissue machine, comprising:

a belt body comprising a body material, the belt body having portions defining a belt inner surface and a belt outer surface;

a reinforcing structure within the body material;

solid lubricant particles bonded with the body material and projecting therefrom, such that portions of the solid lubricant particles are exposed from the body material to define at least 5 percent of the belt inner surface;

wherein the belt inner surface has a roughness value of between 0.20 μm and 6 μm determined in a cross direction of the belt according to standard ISO 4287: 1997; and wherein the belt outer surface is substantially free from the solid lubricant particles.

2. The belt of claim 1 wherein the solid lubricant particles have outer surfaces and a binder covering at least part of the solid lubricant particles outer surfaces, the binder being selected from the group consisting of aliphatic diisocyanate (ADI), aromatic diisocyanate, toluene diisocyanate (TDI) and methylene diphenyl diisocyanate (MDI).

3. The belt of claim 1 wherein the solid lubricant particles are formed of a material selected from the group consisting of polytetrafluoroethylene (PTFE), molybdenum disulfide ($MoS_2$), and graphite.

4. The belt of claim 1 wherein the solid lubricant particles have a first hardness and the body material has a second hardness and wherein the first hardness is greater than the second hardness.

5. The belt of claim 1 wherein the solid lubricant particles have an average diameter from 2 μm to 30 μm, measured as a greatest diameter of each solid lubricant particle and at least 90% of the solid lubricant particles are arranged to a depth of equal to or less than 50 μm, determined as a depth direction from the inner surface of the belt.

6. The belt of claim 1 wherein a plurality of the solid lubricant particles are spaced apart from one another to define a plurality of spaces therebetween, the spaces being disposed to support oil lubricant between the solid lubricant particles, thereby being arranged to reduce a friction between the belt and an installation surface, and wherein the portions of the solid lubricant particles which are exposed from the body material define at least 10% of an area of the belt inner surface.

7. The belt of claim 1 wherein the belt is a sleeve roll belt.

8. The belt of claim 1 wherein the belt is a shoe press belt.

9. A belt for a paper, board, pulp, or tissue machine, arranged to be disposed to run over an installation surface with oil lubricant applied therebetween, the belt comprising:

a belt body comprising a body material, the belt body having portions defining a belt body inner surface and a belt outer surface;

a reinforcing structure within the body material;

solid lubricant particles selected from the group consisting of polytetrafluoroethylene (PTFE), molybdenum disulfide ($MoS_2$), and graphite disposed in a layer underlying the belt body inner surface, such that portions of the solid lubricant particles are exposed from the body material to define at least 5 percent of the belt inner surface, wherein a plurality of the solid lubricant particles are spaced apart from one another to define a plurality of spaces therebetween, the spaces being disposed to support the applied oil lubricant between the solid lubricant particles, thereby being arranged to reduce a friction between the belt and the installation surface, and wherein portions of the solid lubricant particles are exposed from the body material to define at least 5 percent of the belt inner surface.

10. A belt for a paper, board, pulp, or tissue machine, comprising:

a belt body comprising a body material, the belt body having portions defining a body inner surface and a belt outer surface;

a reinforcing structure within the body material;

solid lubricant particles forming a layer having a thickness in a range between 0.002 mm and 0.2 mm, wherein the solid lubricant particles project inwardly from the body inner surface and are exposed from the body material to define at least 5 percent of a belt inner surface;

wherein the belt inner surface has a roughness value of between 0.20 μm and 6 μm determined in a cross direction of the belt according to standard ISO 4287: 1997; and wherein substantially no solid lubricant particles are exposed on the belt outer surface, such that the belt outer surface is substantially free from the solid lubricant particles.

11. The belt of claim 10 wherein the body material comprises a polyurethane matrix and wherein a binder bonds the solid lubricant particles with the body material.

12. The belt of claim 10 wherein the layer formed by the solid lubricant particles is spaced from the reinforcing structure and does not engage the reinforcing structure.

* * * * *